US009194667B2

(12) United States Patent
Chartier et al.

(10) Patent No.: US 9,194,667 B2
(45) Date of Patent: Nov. 24, 2015

(54) METHOD FOR OBTAINING A LINEAR DETONATING SHAPED CUTTING CHARGE, CHARGE OBTAINED BY SAID METHOD

(75) Inventors: Alex Chartier, Rueil Malmaison (FR); Laurent D'Emmanuele, Toulon (FR); Olivier Jeanneau, Les Alluets le Roi (FR)

(73) Assignee: PYROALLIANCE, Les Mureaux (FR)

( * ) Notice: Subject to any disclaimer, the term of this patent is extended or adjusted under 35 U.S.C. 154(b) by 0 days.

(21) Appl. No.: 14/346,257

(22) PCT Filed: Sep. 14, 2012

(86) PCT No.: PCT/FR2012/052064

§ 371 (c)(1),
(2), (4) Date: Sep. 17, 2014

(87) PCT Pub. No.: WO2013/079836

PCT Pub. Date: Jun. 6, 2013

(65) Prior Publication Data

US 2015/0013561 A1 Jan. 15, 2015

(30) Foreign Application Priority Data

Sep. 22, 2011 (FR) ..... 11 58448

(51) Int. Cl.

| | |
|---|---|
| ***F42B 1/028*** | (2006.01) |
| ***C06C 5/04*** | (2006.01) |
| ***C06C 5/08*** | (2006.01) |
| ***F42B 1/02*** | (2006.01) |
| ***F42B 3/08*** | (2006.01) |

(52) U.S. Cl.
CPC . *F42B 1/028* (2013.01); *C06C 5/04* (2013.01); *C06C 5/08* (2013.01); *F42B 1/02* (2013.01); *F42B 3/08* (2013.01)

(58) Field of Classification Search
CPC ..... F42B 1/00; F42B 1/02; F42B 1/036
USPC ..... 102/306–310, 321.1, 476, 475; 89/1.15
See application file for complete search history.

(56) References Cited

U.S. PATENT DOCUMENTS

| | | | | |
|---|---|---|---|---|
| 1,923,761 | A | 8/1933 | Snelling et al. | |
| 3,138,054 | A | 6/1964 | Hatfield | |
| 3,165,057 | A * | 1/1965 | Armstrong | 102/307 |
| 3,185,089 | A * | 5/1965 | Parkhurst et al. | 102/307 |
| 4,297,946 | A | 11/1981 | Paton et al. | |
| 4,693,181 | A * | 9/1987 | Dadley et al. | 102/307 |
| 4,711,181 | A * | 12/1987 | Ringel et al. | 102/476 |
| 4,896,609 | A * | 1/1990 | Betts et al. | 102/309 |

(Continued)

FOREIGN PATENT DOCUMENTS

| | | |
|---|---|---|
| DE | 2724036 | 12/1978 |
| FR | 1605237 | 8/1973 |

(Continued)

*Primary Examiner* — Reginald Tillman, Jr.
(74) *Attorney, Agent, or Firm* — Hamre, Schumann, Mueller & Larson, P.C.

(57) ABSTRACT

The invention relates to a method for obtaining linear detonating shaped cutting charges (100) and to novel linear detonating shaped cutting charges (100) that are able to be obtained by means of said method. Characteristically, the sheath (101) of said charges (100) is shaped before filling and, once filled, it is only slightly deformed for perfect adaptation to the material contained therein. Ultimately, said sheath (101) has concave (C) outer walls (10*a*, 10*b*).

15 Claims, 2 Drawing Sheets

(56) References Cited

U.S. PATENT DOCUMENTS

| | | | | | |
|---|---|---|---|---|---|
| 5,038,683 | A | * | 8/1991 | Baker et al. | 102/308 |
| 5,251,530 | A | * | 10/1993 | Kaeser | 86/20.14 |
| 5,333,550 | A | | 8/1994 | Rodney et al. | |
| 5,501,154 | A | * | 3/1996 | Rodney et al. | 102/331 |
| 5,509,357 | A | * | 4/1996 | Lawther | 102/307 |
| 5,814,758 | A | * | 9/1998 | Leidel | 102/307 |
| 5,827,995 | A | * | 10/1998 | Graham | 102/307 |
| 6,378,438 | B1 | * | 4/2002 | Lussier et al. | 102/307 |

FOREIGN PATENT DOCUMENTS

| | | |
|---|---|---|
| FR | 2590661 | 5/1987 |
| GB | 733592 | 7/1955 |
| WO | WO 95/35477 | 12/1995 |

* cited by examiner

FIG.1
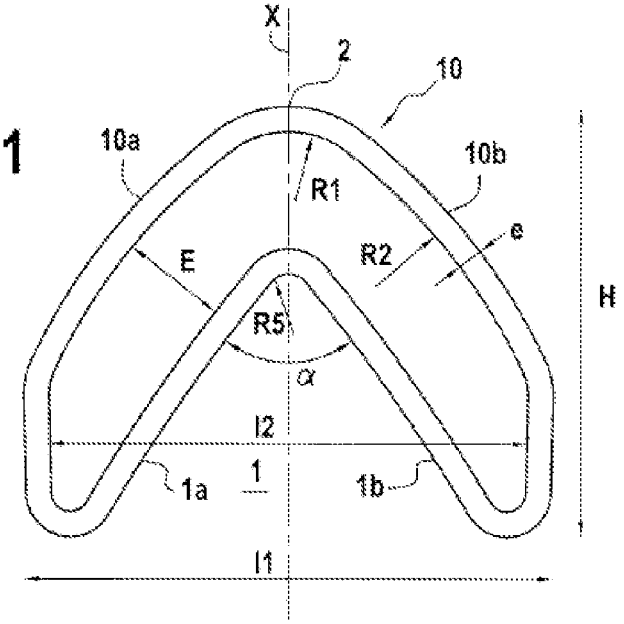
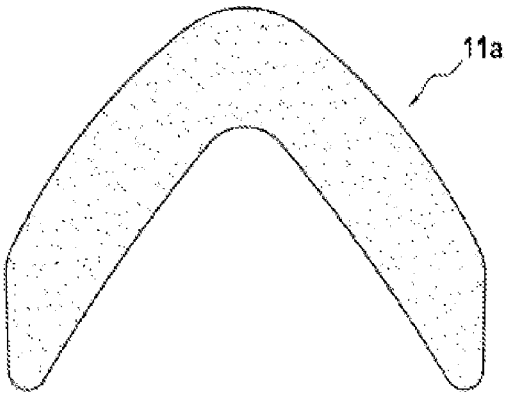
FIG.2A
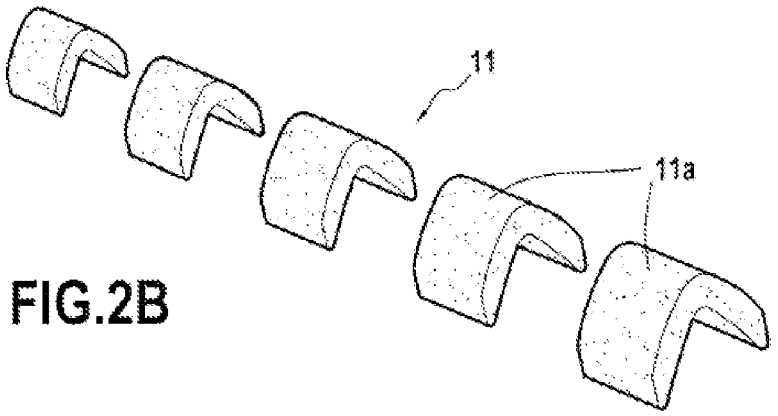
FIG.2B

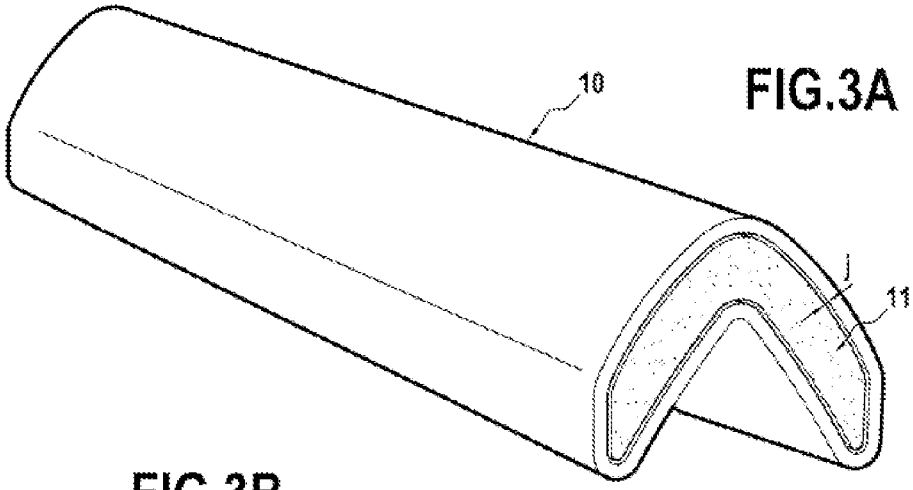
FIG.3A
FIG.3B
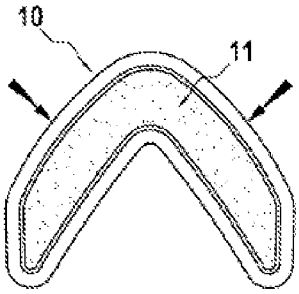
FIG.4
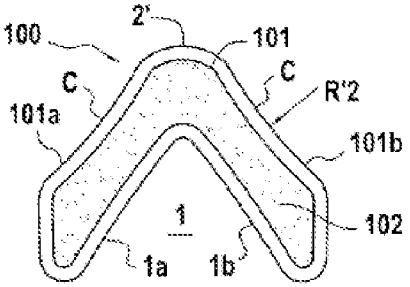
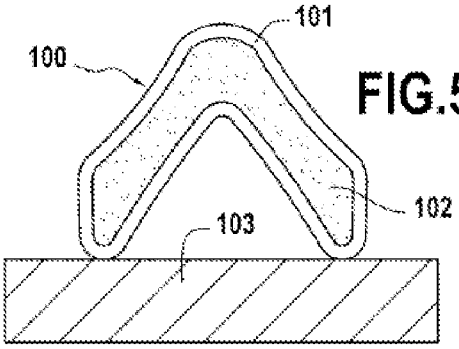
FIG.5A
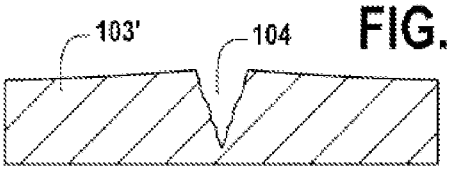
FIG.5B
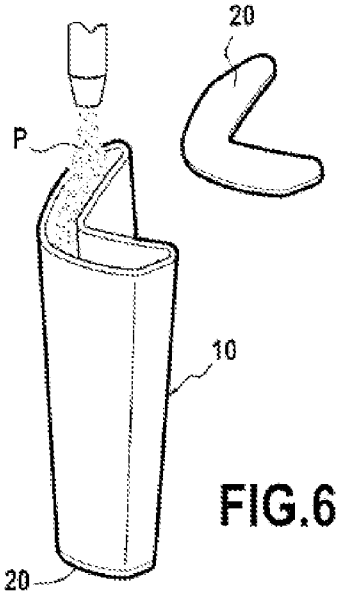
FIG.6

METHOD FOR OBTAINING A LINEAR DETONATING SHAPED CUTTING CHARGE, CHARGE OBTAINED BY SAID METHOD

The invention relates to a method for producing linear detonating shaped cutting charges and to novel linear detonating shaped cutting charges which can be obtained by said method.

A linear detonating shaped cutting charge, that can be used for linear perforation (of a material), comprises an elongate mass of explosive material having, over its length, a cavity in the form of an inverted V-shaped groove, said mass being surrounded by a thin-walled metal coating (metal sheath). The detonation produces a planar metal blade projected at high speed over the length of the groove, said blade being suitable for the linear perforation (of said material). According to one known method for producing such linear detonating shaped charges of this type, for example reviewed in the introduction to the Patent Application FR 2 590 661, a (cylindrical) metal tube, generally made of lead because of the ductility of this material, is filled with explosive granules, then said filled tube is passed through a series of rollers intended to shape it in the form of a bar, having a chevron-shaped cross section. The height of the groove of the chevron is intended to space the charge apart from the work surface, thus allowing for the development of the metal blade when the shaped charge operates.

The linear detonating shaped cutting or perforation charges that are thus produced often have a non-uniform coating thickness and/or microcracking in their coating induced by the significant sectional deformation imposed on the tube over a long length, and the result thereof is a lack of uniformity in the cutting power, and therefore variations in the perforation effectiveness. Moreover, the compression and the deformation of the explosive charge, during the shaping of the tube filled with said charge, can lead to variations in the density of said charge.

The replacement of the lead by less toxic metals, such as copper or molybdenum, metals that are less ductile, make the implementation of this method even more difficult. Also, the significant mechanical forces needed for the deformation of tubes made of these materials that are not very ductile are incompatible with a method implemented with pyrotechnic substances.

Those skilled in the art are therefore seeking a method for producing linear detonating shaped cutting charges that is simple to implement, suited to metals (forming the tubes) with lower ductility than lead and that makes it possible to limit the geometrical defects of the charges produced.

According to its first object, the present invention therefore relates to a method for obtaining a linear detonating shaped cutting charge; said charge comprising, conventionally, a cylindrical metal sheath with chevron-shaped cross section enclosing an explosive energetic material. Characteristically, said method comprises:

- the obtaining of a hollow preformed metal container, having two open distal ends, of cylindrical form with a groove in the form of an inverted V in the longitudinal direction, the cross section of which exhibits a symmetry relative to the median axis of said groove, and which comprises two inner walls delimiting said groove and two outer walls on either side of an apex;
- the obtaining of said container with its internal volume filled with a compression-deformable explosive energetic charge and its distal ends blocked; and
- the deformation by compression of a portion, close to said apex, of each of said outer walls of said filled container blocked at its distal ends, over the entire length of said container, to reduce the filled internal volume of said container, with the aim of canceling the voids of said filled internal volume;

said container, of which a portion of each of said outer walls has thus been made concave, forming said sheath (of said linear detonating shaped cutting charge thus obtained).

It is understood that the deformation is implemented, to obtain the effect sought (elimination of the voids), on a sealed filled internal volume. To this end, any means, of plug type, is involved for blocking the distal ends of the filled container. This blocking advantageously ensures that the material filling the internal volume of the container is maintained under longitudinal compression.

Characteristically, in the context of the implementation of the method of the invention, a container (precursor of the sheath of the final charge) is preformed (to the desired form: conventional shape) before its filling (it is preformed hollow, empty) and, once filled and blocked (the filling involved is intended to occupy all the internal volume of the container), it is weakly deformed (in its part not directly involved in the operation of the final charge, i.e. on its outer walls; its inner walls (those of the inverted V-shaped groove) remaining intact) for its perfect adaptation to the material with which it is filled (in fact, container and content are both weakly deformed in order to perfectly follow the shape of each other, without deformation of the inverted V-shaped groove). The expected linear detonating shaped cutting charge is thus obtained with a cylindrical metal sheath with chevron-shaped cross section enclosing an explosive energetic material. The material filling the internal volume of the container at the time of the compression (filling material, which may have been transformed in situ (see below)) is a compression-deformable material.

According to an advantageous variant implementation, the method of the invention comprises:

- the obtaining of a container as specified above;
- the possible blocking of one of the open distal ends of said container;
- the filling of the internal volume of said container, possibly blocked at one of its distal ends (see above), with a filling material chosen from a compression-deformable explosive energetic charge or a precursor of such a charge;
- the blocking of the two distal ends of said filled container or of the other distal end of said filled container (see above), said blocking ensuring, within said container, that said compression-deformable explosive energetic charge, said precursor or the compression-deformable explosive energetic charge resulting from the in situ transformation of said precursor is maintained under longitudinal compression; an in situ treatment of said precursor ensuring its transformation into a compression-deformable explosive energetic charge being implemented before or after said blocking; and
- the deformation by compression of a portion, close to the apex, of each of the outer walls of said filled container, at the blocked distal ends.

Whatever the exact variant implementation of the method of the invention, on the one hand, the container (empty), precursor of the sheath of the final linear detonating shaped cutting charge has to be obtained and, on the other hand, the filling material for said container, precursor of the explosive energetic material of said charge, has to be available.

With regard to said container, it is advantageously obtained by the shaping of a (hollow) metal tube, notably of such a tube with circular or elliptical section, advantageously of such a tube with circular section. Such a shaping operation is known per se.

Said container can notably be made of copper, molybdenum or lead. It is advantageously made of copper.

With regard to the filling material, it is a compression-deformable explosive energetic charge (required to form—once compressed longitudinally and transversely—the explosive energetic material of the final shaped charge) or a precursor of such a charge (required to be first treated in situ (said treatment in the container generally consisting in a heat treatment or similar to ensure the cross-linking of said precursor) to form such a charge, said charge therefore itself being required to form—once compressed longitudinally and transversely—the explosive energetic material of the final shaped charge).

In a nonlimiting manner, it can be indicated here that the filling material can notably consist:

of at least one explosive bar, of a powder-form charge, with or without binder, or of an explosive with plastic binder, said binder having to be cross-linked.

The nature of such filling materials and the handling of these materials in the method of the invention are specified hereinbelow.

The filling of the container (preformed) can therefore be implemented by the introduction of at least one explosive bar into the internal volume of said container. Said at least one bar has an outline fitted as close as possible to that delimiting the internal volume of the container. It is understood that the mechanical play between said at least one explosive bar and the interior of said container (=the void to be canceled by the operation of compression deformation of a portion of the outer walls of the container) has to be as small as possible, in order to limit the deformation by compression of said container necessary for the mechanical cohesion between said container and said bar, while allowing the introduction of said bar into said container. The acceptable mechanical play is obviously related to the dimensions of said container. Typically, for a container that fits into a rectangle 15 mm high and 20 mm wide (speaking here specifically about the section of said container), the mechanical play between the outlines of said at least one bar and of said container is approximately 0.1 mm.

In the context of this variant implementation of the method of the invention, n bars are generally successively introduced into the container (preformed) for its filling. In practice, since it is difficult to produce long explosive bars and to then introduce them into a container, as a general rule, when said container is very long (>50 mm), a number of bars of shorter lengths, compared to that of said container, are introduced in succession to form a stack inside said container. They are then slightly compressed together, longitudinally, by means of plugs. The bars typically have a length of 10 or so millimeters for a sheath 1 to 2 m long.

With reference to the involvement of such bars, the following can also be specified, in a nonlimiting manner.

Such bars can notably consist:

of bars made up of powder-form charges or compressed granules (without binder; the charges concerned being, for example, charges of RDX, HMX, CL20 or pentrite), bars made up of a wax explosive (notably chosen from the hexowaxes, pentowaxes and octowaxes), or explosive bars with plastic binder (for example of RDX/ammonium perchlorate/polyurethane binder type, obtained by molding).

The filling of the container can also be implemented by the introduction of a powder-form charge, with or without binder (of wax type, for example), followed by a longitudinal compression of said powder-form charge introduced. It will be seen that it is highly advantageous to "pack" said powder-form charge introduced to optimize the filling of the container (to minimize the void to be canceled by the operation of deformation by compression of a portion of the outer walls of the container). The explosive concerned can perfectly well be of the same nature as that present in the bars described above (RDX, HMX, etc.).

The filling of the container can also be implemented by casting an explosive with plastic binder, said casting being followed by a heat treatment ensuring the in situ cross-linking (in the volume of the container) of said binder. The container is here filled with a precursor of a compression-deformable explosive energetic charge, intended to form the explosive energetic material of the final shaped charge. The energetic charge is obtained from said precursor with contraction, whence the void to be canceled in the operation of deformation by compression of a portion of the outer walls of the container.

Those skilled in the art will understand perfectly well that the nature of the filling material is not limited by the details given above, but that any (explosive) filling material, which can be handled for the filling step and then compressed, per se or after transformation, for the cancelation of the voids within the filled container, will be suitable.

The blocking of the distal ends of the preformed container is generally performed in two stages, by fitting a first plug at a first end, before filling, then fitting a second plug at the second end, after filling. However, with certain types of filling materials, the fitting of the two plugs after filling is not precluded.

The plugs are advantageously fitted with an adhesion means, such as mastic. They can then be positioned in a perfectly stable manner, while ensuring a perfect seal. Said plugs, in any case, contribute to the rigidity of the assembly.

Two types of plugs can notably be used. Plugs, not retained at the end of the process, are likely to be involved as simple production auxiliaries of the desired charges. It is in fact possible, after the deformation by compression of the filled preformed container blocked at both its ends with such plugs, to cut said two blocked ends to create end faces, visible, clean, with exposed explosive. Such faces are generally then coated with a protective lacquer. Other plugs, of more complex structure, suitable for receiving a detonator, a transmission line piece or a detonation relay, can be used in the method of the invention and retained at the distal ends of the final charge obtained.

The deformation (or forming) of the blocked filled container can be performed according to different methods and notably by rolling said filled container between rollers or by passing said filled container through a die or a linear press.

In light of the effect sought and of the nature of the final product sought, it is understood that the deformation involved is a weak deformation, that the compression involved is a compression of weak intensity. The aim is to perfect the filling of the container (by weakly limiting its internal volume by weak deformation (of a portion) of its outer walls, without affecting the part of said container, mainly responsible for the technical effect (pyrotechnic effect) sought: the inverted V-shaped groove). Advantageously, the perimeter of the section of the (filled) container is not modified by the compression (forming) operation. The internal stresses are thus minimized. Very advantageously, a convex portion (having a radius of curvature of a given value) is deformed into a concave portion (exhibiting a radius of curvature of the same value).

Those skilled in the art have already understood all the benefits of the method of the invention. The weak deformation by compression of the container, preformed to the suitable shape and filled, makes it possible to limit the mechanical stresses imposed on said container and thus avoid the risks of the appearance of microcracks, and does so without generating any significant longitudinal deformation. Moreover, the method of the invention makes it possible to best control the wall thicknesses of the sheath of the final shaped charge. The material contained in the container (like the at least one explosive bar detailed above) undergoes only a weak deformation, generating weak axial and longitudinal stresses. These weak stresses ensure a perfect contact between said material and the internal surface of the deformed container (=the sheath of the final shaped charge) and between said material and the end plugs, as well as between the various bars when a number of bars are involved. It can also be stated that, in a context of use of such bars, the weak deformation of said bars also ensures that the linear density of the bars in the final shaped charge is almost identical to that of the initial bars.

According to its second object, the present invention relates to a linear detonating shaped cutting charge, comprising, conventionally, a cylindrical metal sheath with chevron-shaped cross section enclosing an explosive energetic material. Said charge is novel in that it can be obtained by the original method, as described above (forming the first object of the present invention). Said charge is novel in that it bears the marks of such a production method. Its sheath exhibits, over the entire length of each of its outer faces, facing its inner faces delimiting the inverted V-shaped groove, a concavity. Said concavity extends longitudinally over the portion of said outer faces facing said inner faces. This concavity is the mark, the signature, of the compression deformation step.

The charges of the invention, obtained by the above method implemented from a hollow tube (of circular section), generally have their sheath, which has a dome prolonged by its outer walls, with concavity, bent back to form the inverted V-shaped groove delimited by its inner walls.

The invention, in its product and method aspects, is illustrated, in a nonlimiting manner, in the appended figures and by the example below.

FIG. 1 shows, schematically, a cross section of a preformed metal container, suitable as precursor of a sheath of a linear detonating shaped cutting charge of the invention.

FIG. 2A shows, from the front, an explosive bar to be introduced into the container of FIG. 1, for the production of a linear detonating shaped cutting charge of the invention.

FIG. 2B shows, in perspective, a series of such bars (to be introduced into the container of FIG. 1, for the production of a linear detonating shaped cutting charge of the invention).

FIG. 3A shows, in perspective, the container of FIG. 1 filled with a series of explosive bars (before the implementation of the deformation by compression).

FIG. 3B, a view in cross section of FIG. 3A, schematically represents the step of deformation by compression of the filled container.

FIG. 4 is a view in cross section of a linear shaped charge according to the invention.

FIG. 5A shows the charge of FIG. 4 positioned on a reference target (before the operation of said charge).

FIG. 5B shows said target cut by said shaped charge according to the invention (after operation of said charge).

FIG. 6 illustrates the filling of a container according to FIG. 1 with a powder-form charge.

FIG. 1 clearly shows the groove 1 and the rounded apex 2 of the hollow (empty) metal container 10. The inner walls of said container 10 are referenced 1*a* and 1*b* (they delimit said groove 1); the outer walls of said container 10 are referenced 10*a* and 10*b*. The cross section of said container 10 is symmetrical relative to the axis X of the groove 1. The structure of said container 10 is a symmetrical cylindrical structure. In FIG. 1, the following are referenced:

H, the height of the container 10,

I1, its outer width,

I2, its inner width,

E, the width of the cavity to be filled,

α, the aperture angle of the groove 1,

R1, R2 and R5, radii of curvature (R2 quantifies the convex curve of the portion of the walls 10*a* and 10*b*, close to the apex 2), e, the thickness of the walls (10*a*, 10*b*, 1*a* and 1*b*) of the container 10.

In the context of the example, values for these dimensional characteristics of the container 10 (precursor of a sheath 101 of a charge 100 of the invention (see FIG. 4)) are specified hereinbelow.

Those skilled in the art will easily see that containers having different forms from that represented in FIG. 1 are also suitable for the purposes of the invention, notably containers of similar but not identical form: having smaller dimensions and a more rounded appearance.

FIG. 2A therefore shows, from the front, an explosive bar 11*a* to be introduced into the container 10 of FIG. 1, for the production of a linear detonating shaped cutting charge 100 of the invention (see FIG. 4). Said bar 11*a* has a geometry perfectly matched to that of the container 10. Its outline is fitted as close as possible to that of the internal volume of the container 10. Said bar 11*a* must be able to be positioned in the sheath 10 with a minimal mechanical play.

FIG. 2B shows, in perspective, a series 11 of such bars 11*a* (to be introduced in succession into the container 10 of FIG. 1, for the production of a linear detonating shaped cutting charge 100 of the invention). Said series 11 of bars 11*a* schematically represents the filling charge (compression-deformable explosive energetic charge) of said container 10. It has been seen above that such a filling charge can be made up of very many bars 11*a* of short length (see the example below).

FIG. 3A shows the container 10 of FIG. 1, after the stacked-mode insertion (i.e. filled) of n bars 11*a* of FIGS. 2A and 2B. These n bars 11*a* therefore form the filling charge 11. In said FIG. 3A, the mechanical play between said charge 11 and said container 10 is referenced j. It will be noted that the stack of bars is flush with the visible end (in fact, the distal ends) of the container 10.

The implementation of the compression, for deformation of a portion of the outer walls 10*a* and 10*b* of the filled container 10 (of the n explosive bars 11*a*), is schematically represented by the black arrows in FIG. 3B. Said compression is obviously implemented on the container 10 when filled and blocked.

FIG. 4 shows a section of the linear shaped charge 100 obtained after deformation by compression of the sheath 10 containing the explosive bars 11*a*. It will be observed that the deformation of said sheath 10, during the compression, results in a concavity C of the portion of the outer walls 101*a* and 101*b* (of the deformed sheath 101) close to the apex 2' (these walls corresponding to the walls 10*a* and 10*b* of said sheath 10, before deformation thereof) and a perfect contact between the final charge 102 corresponding to the filling charge 11 (made up of the n bars 11*a*, also slightly compressed) and the inner surface of the sheath 101 (deformed sheath 10). The play j of FIG. 3A has been eliminated. R'2 (radius of curvature) quantifies said concavity C.

FIGS. 5A and 5B are described in the example below.

FIG. 6 illustrates another variant implementation of the method of the invention, more particularly another variant implementation of the step of filling of the container 10. Instead of the bars 11*a*, a powder P is used. In said FIG. 6, the plugs of the distal ends of the sheath 10 are represented by 20. According to the variant represented, one of said two distal ends has first of all been blocked by a first plug 20, and the filling with the powdered filling material P is then performed. After said filling and a longitudinal compression of the powder (for its packing), the second distal end of the filled sheath 10 is blocked, with longitudinal compression. The operations of filling and of blocking of the second end are thus implemented in conditions which ensure that the desired longitudinal compression is maintained (to minimize the voids to be compensated by the subsequent deformation by compression of the container 10 filled with powder P).

EXAMPLE

Said example is described with reference to the appended FIGS. 1 to 5B.

A container, as shown in FIG. 1, is formed cold, from a copper tube of circular section. It has the following dimensional characteristics:

H=14.2 mm,
I1=17.6 mm,
I2=16 mm,
E=4 mm,
$\alpha$=70°,
R1=4.2 mm, R2=20.5 mm, R5=1.7 mm,
e=0.8 mm, and
length=2000 mm.

A first plug (made of epoxy resin) is positioned (stably, with a mastic) at one of the ends of this preformed container. It penetrates into said container to a depth of 25 mm.

Said container is filled, over its length, with 130 explosive bars, as shown in FIGS. 2A and 2B. Each of said bars has a length of 15 mm. The preformed container is thus filled over a length of 1975 mm by the stacking of the first plug and of the 130 bars. The explosive used is a granular explosive of hexo-wax type containing, as a percentage by weight, 98% hexogene and 2% inert binder. The play between the internal outline of the container and the external outline of the bars (play j shown in FIGS. 3A and 3B) is 0.1 mm.

Another plug (of the same type as the first) is then positioned (in the same way), in the remaining volume, at the other end of the filled preformed container, so as to slightly compress the stack of bars in said preformed container. A tight contact is thus assured between each bar and its neighbors. A tight contact is also thus assured between the end plugs and the bars situated at the end of the stack (at the distal ends of the container). The filled container is then made perfectly rigid.

The compression of the outer walls of the preformed, filled and plugged container, more specifically of a portion of said walls (in accordance with FIG. 3B) is performed by rolling said container between rollers. The result of this is the concavity of said portion of said walls, quantified by the radius of curvature R'2: R'2=20.5 mm. Such a deformation (R2=20.5 mm to R'2=20.5 mm) is made without variation of the perimeter of the section of the container.

The plug ends are cut and, finally, the shaped charge of the invention obtained (as represented in FIG. 4) has a (total) linear mass of 560 g/m and a linear mass of explosive of 135 g/m. Said shaped charge has end faces, visible, clean, with exposed explosive. This shaped charge 100 is effective. It is used as schematically represented in FIG. 5A, i.e. positioned on a reference target 103 made of mild steel C22 E (Rm=460 Mpa, A=30%). Given the depth of the groove 1 of the charge 100, the firing distance ("stand-off") is 9 mm. After (conventional) operation of the shaped charge 100, the linear perforation obtained 104 penetrates into the target 103 by a depth of approximately 15 mm, as shown in FIG. 5B. The target 103 with said linear perforation 104 is referenced 103'.

The invention claimed is:

1. A method for obtaining a linear detonating shaped cutting charge, said charge comprising a cylindrical metal sheath with chevron-shaped cross section enclosing an explosive energetic material, the method comprising:

providing a hollow preformed metal container that extends from a first open distal end to a second open distal end, thereby defining a longitudinal axis, the hollow preformed metal container having a cylindrical form with a groove in the form of an inverted V along the longitudinal axis, a cross section of which has a chevron-shape and exhibits a symmetry relative to the median axis of said groove, and which comprises two inner walls delimiting said groove and two outer walls on either side of an apex of the chevron shape as viewed in cross-sectional side view;

providing said container with an internal volume filled with a compression-deformable explosive energetic charge; and deforming said outer walls along the longitudinal axis so that each of the outer walls is concaved inwardly towards the respectively facing inner wall as viewed in cross-sectional side view, thereby reducing the filled internal volume of the container as compared to that of before the deformation of the outer walls so as to remove voids present in said filled internal volume without deformation of the inverted V groove, wherein the open distal ends are blocked before the outer walls are deformed.

2. The method as claimed in claim 1, wherein the internal volume of the container is filled with a filling material chosen from a compression-deformable explosive energetic charge and a precursor of such a charge; and wherein the container is blocked so as to ensure that, within said container, said compression-deformable explosive energetic charge, said precursor of such a charge or a compression-deformable explosive energetic charge resulting from an in situ transformation of said precursor is maintained under longitudinal compression, an in situ treatment of said precursor ensuring transformation of the precursor into a compression-deformable explosive energetic charge being implemented before or after said blocking.

3. The method as claimed in claim 1, wherein said container is obtained by shaping a hollow metal tube.

4. The method as claimed in claim 1, wherein said container is made of copper, molybdenum or lead.

5. The method as claimed in claim 1, wherein said filling is implemented by introducing at least one bar with an outline fitted to that delimiting the internal volume of the container.

6. The method as claimed in claim 5, wherein said at least one bar is a bar made up of powder-form charges or compressed granules, a bar made up of a wax explosive or an explosive bar with plastic binder.

7. The method as claimed in claim 1, wherein said filling is implemented by introducing a powder-form charge, with or without binder, followed by a longitudinal compression of said powder-form charge that has been introduced.

8. The method as claimed in claim 1, wherein said filling is implemented by casting an explosive with plastic binder, followed by a heat treatment ensuring the in situ cross-linking of said binder.

9. The method as claimed in claim 1, wherein said deformation is performed by rolling the container between rollers or by passing the container through a die or a linear press.

10. A linear detonating shaped cutting charge, comprising a cylindrical metal sheath with chevron-shaped cross section enclosing an explosive energetic material, able to be obtained by the method as claimed in claim 1, wherein the sheath of which exhibits, over the entire length of each of outer faces thereof, facing inner faces thereof which delimit the inverted V-shaped groove of the chevron shape, a concavity.

11. The charge as claimed in claim 10, wherein said sheath has a dome prolonged by outer walls thereof bent back to form the inverted V-shaped groove, delimited by inner walls thereof.

12. The method as claimed in claim 1, wherein said container is made of copper.

13. The method as claimed in claim 1, wherein said filling is implemented by successive introduction of n bars with an outline fitted to that delimiting the internal volume of the container.

14. The method as claimed in claim 2, wherein one of the open distal ends is blocked before filling the internal volume of said container with the filling material.

15. The method as claimed in claim 2, wherein the open distal ends are blocked after the internal volume of the container has been filled with the filling material.

* * * * *